US005803182A

United States Patent [19]

Bakke

[11] Patent Number: 5,803,182

[45] Date of Patent: Sep. 8, 1998

[54] BIDIRECTIONAL HYDRAULIC JAR

[75] Inventor: Stig Erling Bakke, Ålgård, Norway

[73] Assignee: Gefro Oilfield Services, Tananger, Norway

[21] Appl. No.: 648,075

[22] PCT Filed: Feb. 9, 1994

[86] PCT No.: PCT/NO94/00035

§ 371 Date: May 17, 1996

§ 102(e) Date: May 17, 1996

[87] PCT Pub. No.: WO94/18428

PCT Pub. Date: Aug. 18, 1994

[30] Foreign Application Priority Data

Feb. 10, 1993 [NO] Norway ..... 930455

[51] Int. Cl.[6] ..... E21B 4/14

[52] U.S. Cl. ..... 173/91; 173/137; 173/212; 175/296

[58] Field of Search ..... 173/206, 91, 212, 173/73, 78, 80, 135, 137, 121; 175/296, 299

[56] References Cited

U.S. PATENT DOCUMENTS

| | | | |
|---|---|---|---|
| 3,361,220 | 1/1968 | Brown . | |
| 4,462,471 | 7/1984 | Hipp . | |
| 5,025,868 | 6/1991 | Wentworth et al. | 173/91 |
| 5,148,878 | 9/1992 | Schmidt et al. | 173/91 |
| 5,172,771 | 12/1992 | Wilson | 173/91 |

FOREIGN PATENT DOCUMENTS 2 089 400 6/1982 United Kingdom .

*Primary Examiner*—Scott A. Smith
*Attorney, Agent, or Firm*—Frommer Lawrence & Haug LLP; William S. Frommer

[57] ABSTRACT

A double-acting hydraulic striking tool, wherein a hammer's (8) upper end (9) is rigidly connected to an upper piston (10), and wherein the hammer's (8) lower end (26) is rigidly connected to a lower piston (26). The pistons (10, 27), which can be displaced within a tubular housing (11), are adapted to open and close for a forced flow of liquid from the upper end (9) of the hammer (8) towards the lower end (26). The hammer (8) is activated for downwardly directed blows by pressing against the hammer's (8) upper end (9) with a resilient force, causing the lower piston (27) to close the liquid flow, whereby the housing (11) is lifted hydraulically until the piston (27) opens for the liquid flow, and the forced spring force drives the housing (11) downwardly to impinge on the hammer's (8) lower end (26) through impact faces (34, 36). The hammer (8) is activated for upwardly directed strokes by lifting the upper end (9) of the hammer (8) as well as the housing (11) with a resilient force, so that the upper piston (10) closes for liquid, whereby the piston (10) drives the hammer's (8) upper end (9) downwardly until the piston (10) opens for liquid, whereafter the upwardly acting resilient force drives the hammer's (8) upper end (9) upwards to impinge on the housing (11) through impact faces (33, 35).

6 Claims, 9 Drawing Sheets

BIDIRECTIONAL HYDRAULIC JAR

FIELD OF THE INVENTION

The invention relates to a double-acting hydraulic striking tool, especially for use with fishing operations within oil wells.

BACKGROUND OF THE INVENTION

When drilling for oil and gas and with maintenance of production wells, there is a need for picking up objects which either are mounted downhole or which unintentinally have fallen into the well, and a large number of tools for use in socalled fishing operations have been developed. It is sometimes necessary to be capable of loosening objects which have got stuck within the well, and a plurality of tools and methods have been known in order to supply impacts in order to loosen or crush a stuck object. In many cases, it is necessary to be capable of supplying upwardly directed impacts to the object stuck, and, since the access always is from above, it is necessary to fix a grip in the object in order to obtain the purpose.

Gradually, it has become usual to use hydraulic striking tools mounted at the end of a coil pipe and lowered into the well toward the object stuck. Energy is supplied in that liquid is pumped through the striking tool, often such that the liquid circulates in the well. From U.S. Pat. No. 4,462,471 a hydraulic double-acting striking tool is known, giving downwardly directed impacts when subjected to axial pressure load and upwardly directed impacts when subjected to axial tensile load. Thus, the direction of impact may be changed when raising and lowering the coil pipe, at the end thereof the striking'tool is suspended. Striking effect is achieved in that a moving impact mass which is resiliently suspended within the striking tool, is put into oscillations by the flowing liquid and strikes against a part of the tool which is attached to the object to which impacts are to be supplied. A disadvantage of the striking tool known from U.S. Pat. No. 4,462,471 is that the strength of impact can not be adjusted. Another disadvantage is that the striking effect can not be neutralized without stopping the circulation of liquid.

OBJECTS OF THE INVENTION

An object of the invention is to provide a double-acting hydraulic striking tool wherein the striking strength can be adjusted. Further, it is an object that the the direction of striking is easily reversible, and that the striking effect is neutralizable without reducing or stopping the circulation of liquid.

The objects are achieved through features as defined in the following claims.

SUMMARY OF THE INVENTION

The invention's mode of operation is described in the following. The striking effect is obtained in that a movable mass first is accelerated with a force from a tensioned spring and then impinges against a rest. The mass is assigned a piston adapted to be opened and closed in order to let liquid pumped through a supply pipe, respectively pass freely or drive the piston forwardly. When the piston is closed, the piston is moved by the liquid flow, and the spring is tensioned. Thereafter, when the piston opens the through-flow, the spring is released and, upon its return towards the initial position thereof, accelerates the movable mass and the piston returns to initial position. A new sequence starts when the piston again closes through-flow of liquid.

The invention comprises two independent pistons each assigned its moving mass, of which the first piston is adapted to tension the spring in the same direction as the liquid flows, the second piston being adapted to tension the spring in the opposite direction. By letting the first piston be open and then, alternately, opening and closing the second piston, a hammering effect is achieved. The direction of striking can be reversed by letting second piston be open and then, alternately, opening and closing the first piston. By letting both pistons be open, the striking effect is neutralized.

Available impact energy depends on how much the spring is tensioned, and this is determined through the stroke of the pistons, i.e. the distance from the position where a piston closes the through-flow of liquid to the position where the piston opens the through-flow of liquid. Available impact energy can also be increased through pretensioning the spring. Moreover, the striking effect can be increased through a combination of pretensioning and increased piston stroke.

A preferred embodiment of the invention is adapted such that, without tensioning the spring, both pistons are open to allow through-flow and, then, the striking effect fails to appear. When the spring is tensioned manually in one direction to a prestressing state, the piston tensioning the spring is further activated hydraulically in the same direction, the second piston remaining open. Through tensioning the spring manually in the opposite direction, the roles of the pistons are reversed, the direction of impact being reversed as well. The preferred embodiment of the invention consists of two main units, namely an accelerator including the spring and a hammer comprising two moving masses and said pistons. Accelerator and hammer are interconnected to one unit when the striking tool is in use.

BRIEF DESCRIPTION OF THE DRAWINGS

An examplary embodiment of the invention is described in the following with reference to the attached drawings, wherein.

DETAILED DESCRIPTION OF CERTAIN PREFERRED EMBODIMENT

Figure 1:
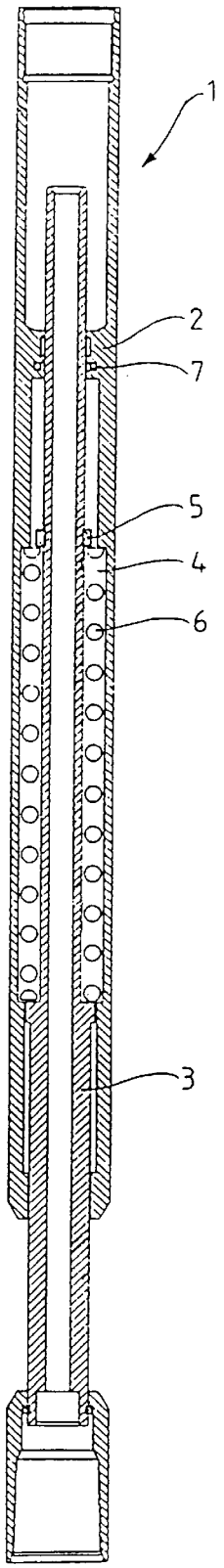
FIG. 1 shows an accelerator in a front view, wherein the spring is not tensioned.

In FIG. 1, reference numeral 1 denotes a tubular accelerator having an external pipe 2 wherein an axially displaceable internal pipe 3 is disposed. The internal diameter of the external pipe 2 is increased in a defined area 4, simultaneously as the external diameter of the internal pipe 3 is reduced in a corresponding area which, at one end thereof, is defined by a stop ring 5, and, in the resulting annulus, a compressible spring has been disposed. A packer 7 seals between the external pipe 2 and the internal pipe 3, so that liquid does not leak into the annulus between the two pipes. The external pipe 2 is divisible in joints, not shown, in order to allow mounting of the stop ring 5, the spring 6 and the packer 7. The spring 6 is compressed both when the internal pipe 3 is displaced into or out of the external pipe 2. The accelerator 1 is, at the upper end of the external pipe 2, adapted to be coupled to a pipe, not shown, carrying a pressurized liquid, the accelerator 1, at the lower end of the internal pipe 3, being adapted to be coupled directly or through intermediate pipe(s) to the upper end 9 of a hammer 8, see FIG. 2.

The upper end 9 of the hammer 8 is rigidly connected to an upper piston 10 adapted to be displaced axially within a tubular housing 11. The upper end 9 of the hammer together with the piston 10 constitute a moving mass which is active upon upwardly directed blows, the housing 11 constituting a moving mass which is active upon downwardly directed blows. The piston 10 is provided with a through-going, axially directed channel 12 which is in connection with the upper end 9 of the hammer. Within the upper end of the channel 12, an axially displaceable, upper, tubular plug 13 is disposed, the lower end thereof being adapted to seal against an internal seat 14 in the lower end of a widened cavity of the channel 12. The tubular plug 13 is adapted to conduct liquid into the channel 12 through gates 15 in the lateral wall of the plug 13. A prestressed upper spring 16 is mounted within the housing 11 and presses upwards against the lower end of the plug 13 through a spacer 17. The upper end of the plug 13 rests against a hoop 18, traversing the piston 10 in grooves 19, 20 in the side wall of the piston 10. The grooves 19, 20 have a clearance to the hoop 18, and the hoop 18 does not prevent movement of the piston 10. At the upper end, the hoop 18 rests against a land area 21 of the housing 11, to which the hoop 18 is rigidly connected. Besides, the hoop 13 is shown more in details 15, the upper end 9 of the hammer 8, including piston 10 and grooves 19, 20, being shown more in details 16, 17 and 18.

In a channel 22 beneath the spring 16, a lower tubular plug 23 is disposed, the upper end thereof resting against a land area surrounding the channel 22, said plug 23 being pressed upwardly against said land area by means of a prestressed lower spring 24 through a lower spacer 27, analogous with the upper plug 13, the upper spring 16 and the upper spacer 17. The lower tubular end 26 of the hammer 8 is adapted to be coupled directly or through intermediate pipe(s) to equipment, not shown, to which the hammer 8 is to transfer strokes. The lower end 26 of the hammer 8 is rigidly connected to a lower piston 27 having an axially through-going channel 28. The lower end of the plug 23 is adapted to seal against a seat 29 disposed in the lower end of a widened cavity of the channel 28. Further, the side wall of the tubular plug 23 is provided with gates 30, so that the plug can conduct liquid into said cavity of the channel 28. Besides, it may be mentioned that the spacer 25 projects through grooves 31, 32 in the side wall of the hammer's 8 lower portion 26 and, thus, rests against the spring 24, which is mounted within the annulus between the housing 11 and the lower portion 26 of the hammer 8. At the upper and lower end thereof, the housing 11 is provided with impact faces 33, 34 striking against corresponding impact faces 35, 36 on the upper part 9 and the lower part 26 of the hammer 8. Further, the lower portion 26 of the hammer 8 as well as the housing 11 are provided with contact faces 37, 38 adapted to rest against each other in periods of the hammer's 8 working cycle.

The housing 11 and other components of the hammer 8 are divisible in joints, not shown, in order to enable manufacturing, mounting and disassembling.

Figure 2:
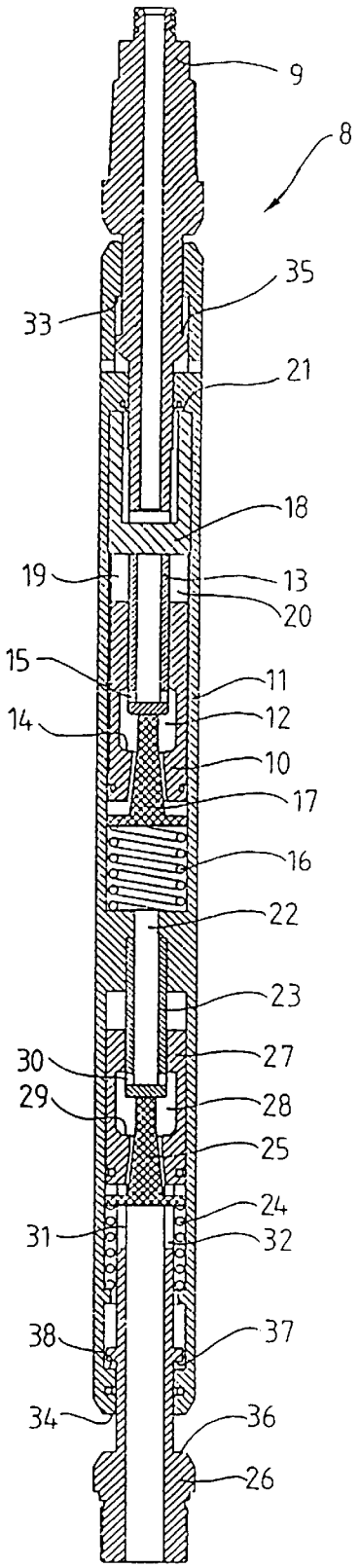
FIG. 2 shows a hammer in a front view and in a neutral position, both pistons, an uppermost and a lowermost, being open for through-flow of liquid, corresponding to the accelerator in FIG. 1.

When the striking tool is in use and the accelerator 1 and the hammer 8 take the neutral position, such as shown in FIGS. 1 and 2, liquid flows from the upper end of the accelerator 1 through the internal pipe 3; through the upper tubular portion 9 of the hammer 8 through the gates 15 in the tubular plug 13 and out into the channel 12 of the piston 10; and further past the seat 14 to beneath the piston 10 and past the spring 16 to the channel 22; and from there through the gates of the tubular plug 23 to the channel 28 of the piston 27; past the seat 29 to beneath the piston 27, through the grooves 31, 32 and out through the lower tubular portion 26 of the hammer 8.

The hammer 8 can be shortened and lengthened upon displacement of the pistons 10, 27 within the housing 11. By pressing against the upper and lower end 9, 26 of the hammer 8, the hammer 8 is shortened, the upper piston 10 being displaced to the lower end position thereof, and the lower piston 27 being displaced to the upper end position thereof within the housing 11. Then, the upper piston 10 is open for through-flow of liquid, and the lower piston 27 is closed, the lower plug 23 sealing against the seat 29. The hammer 8 is shown in the shortest condition thereof 4. By pulling the upper and lower end 9, 26 of the hammer 8, the hammer 8 is lengthened, the upper piston 10 taking its upper end position, and the lower piston 27 taking its lower end position within the housing 11. Then, the upper piston 10 is closed for through-flow of liquid, the plug 13 sealing against the seat 14. Simultaneously, the lower piston 27 is open for through-flow of liquid. The hammer 8 is shown in the longest condition thereof 10.

In the following, the mode of operation of the striking tool is described, first with downwardly directed impact direction and, then, with upwardly directed direction of impact. In both cases, the lower end 26 of the hammer 8 is imagined to be rigidly connected with the object to be alloted blows, typically an object stuck within an oil well. Thus, the lower end 26 of the hammer 8 with the lower piston 27 is kept stationary in relation to the surroundings.

Figure 3:
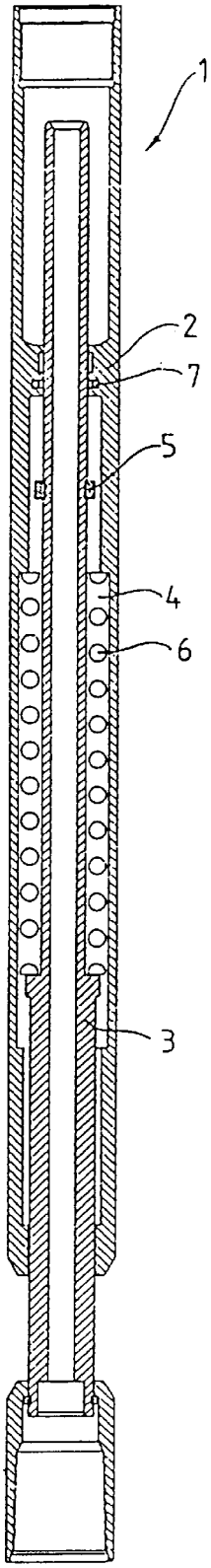
FIG. 3 shows the accelerator upon downwardly directed manual pretensioning of the spring.
Figure 4:
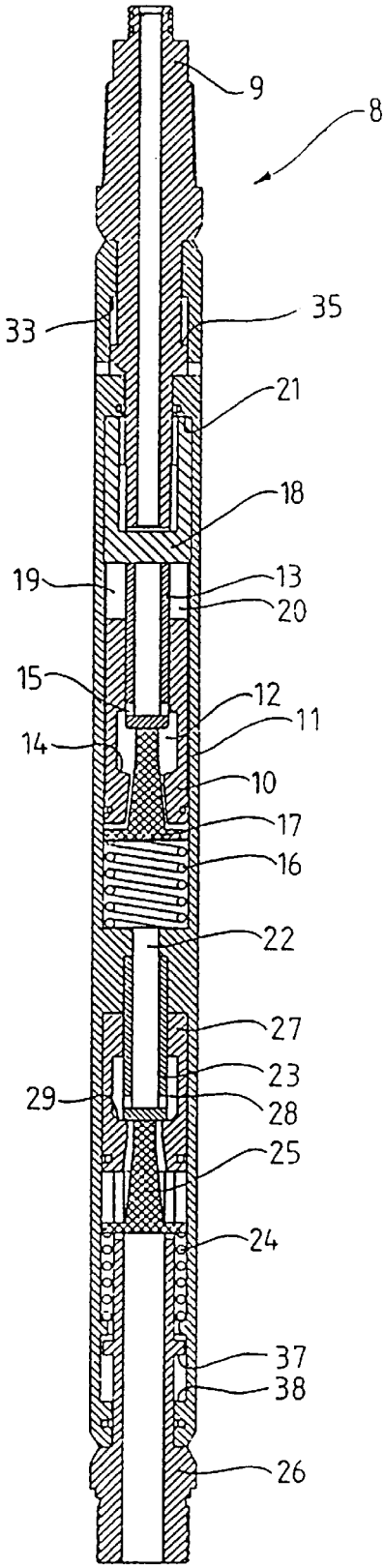
FIG. 4 shows the hammer when the lower piston just has closed and is ready to tension the spring further hydraulically, corresponding to the accelerator in FIG. 3.
Figure 5:
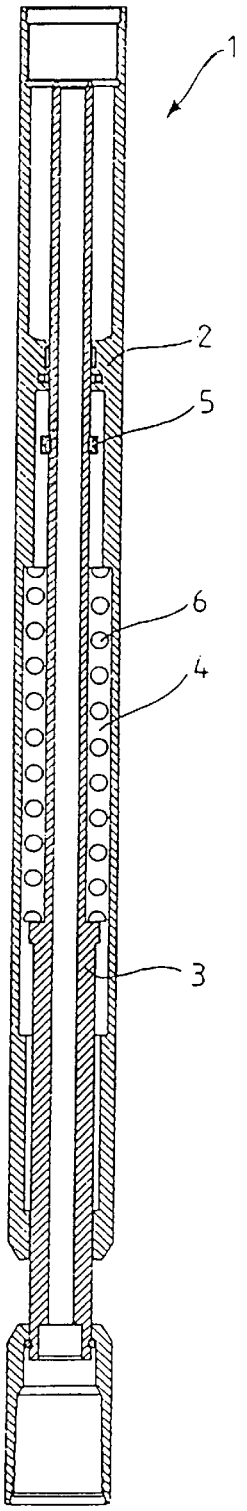
FIG. 5 shows the accelerator wherein the spring has been further tensioned by the hammer.
Figure 6:
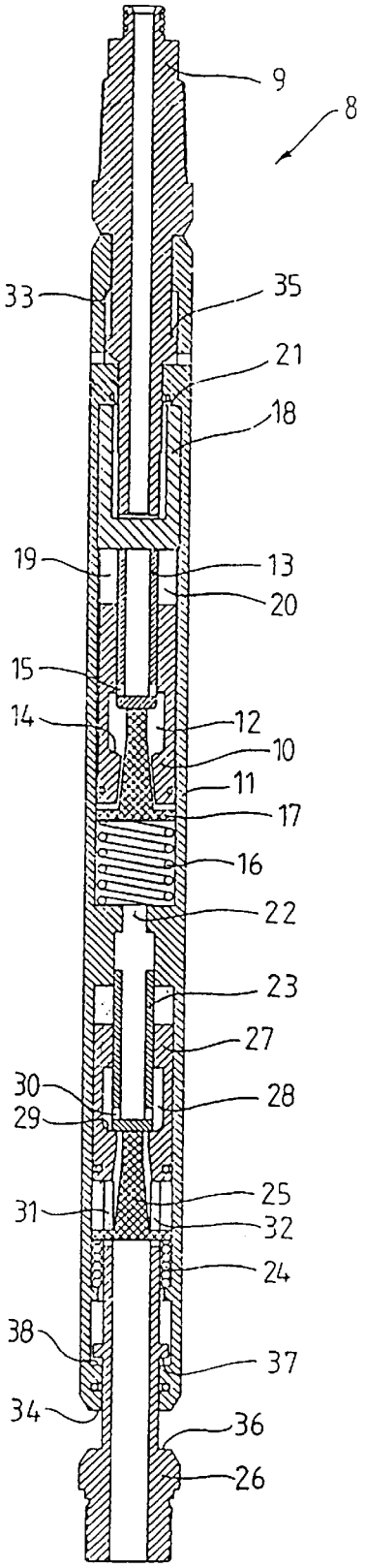
FIG. 6 shows the hammer wherein the lower piston takes an end position, just before the through-flow of liquid is opened, corresponding to the accelerator in FIG. 5.
Figure 7:
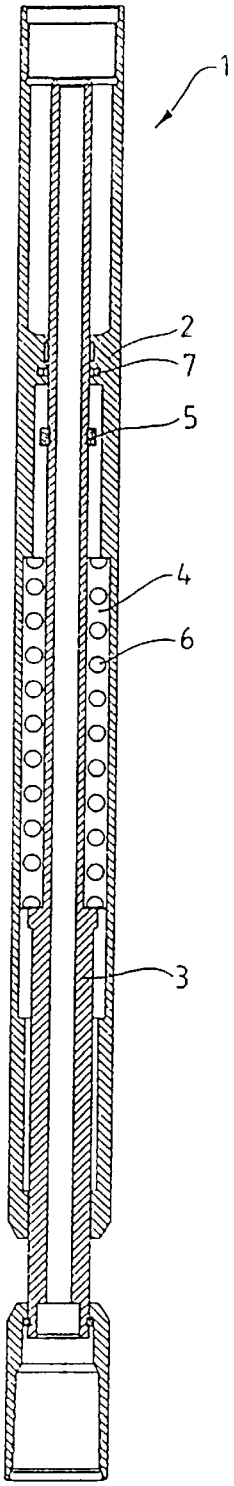
FIG. 7 shows the accelerator, the spring being released.
Figure 8:
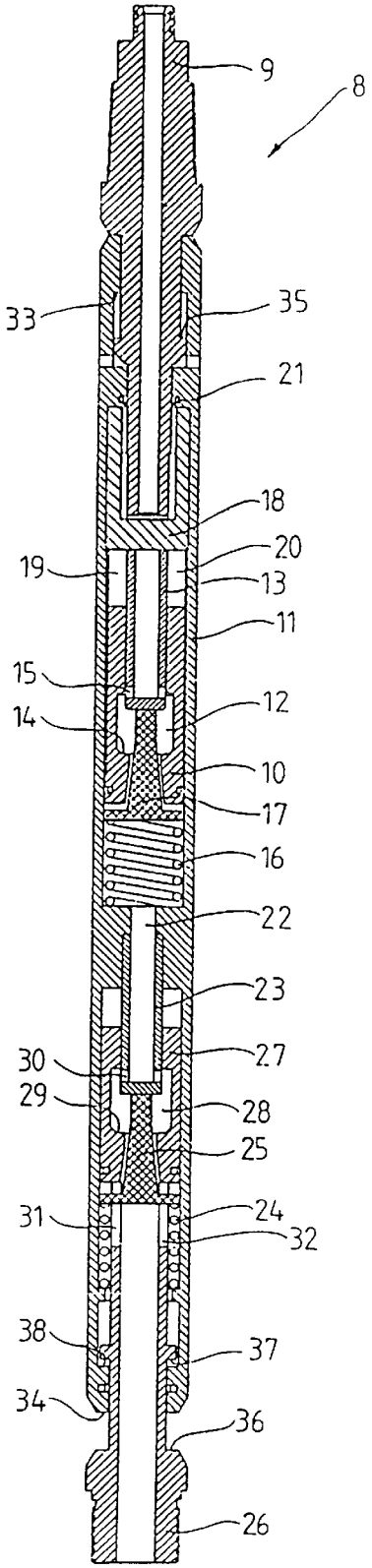
FIG. 8 shows the hammer wherein the lower piston has opened for through-flow of liquid, corresponding to the accelerator in FIG. 7.

Downwardly directed strokes are achieved by supplying a downwardly directed force to the external pipe 2 of the accelerator 1, pushing the supply pipe, not shown, coupled to the upper end of the accelerator 1. The external pipe 2 of the accelerator 1 is pushed downwards, simultaneously as the spring 6 is compressed, see FIG. 3. The downwardly directed force is transferred through the spring 6, now prestressed, to the internal pipe 3 of the accelerator 1 and, from there, to the upper end 9 of the hammer 8. Thus, the hammer 8 is shortened as already explained and shown 4. Because of the fact that the lower piston 27 does not allow through-flow, the liquid pressure above the lower piston 27 increases. As the piston 27 can not be moved, the increased liquid pressure causes the housing 11 to be lifted, and the upper end 9 of the hammer 8 follows the housing 11 upwards. The lower plug 23 does not follow the housing 11 upwards, but remains stationary, sealing against the seat 29 of the piston 27. The plug 23 presses against the seat 29 with a force constituting the difference between the downwardly directed hydraulic force caused by liquid pressure against the cross-section of the plug 23 and the upwardly acting force from the prestressed spring 24. The housing 11 and the upper end 9 of the hammer 9 is, consequently, lifted against the downwardly acting spring force from the prestressed spring 6 og the accelerator 1 which, thus, is tensioned further. Simultaneously, the upwardly directed movement of the housing 11 compresses the lower spring 24 of the hammer 8, so that this too is tensioned further. There will be conformity between the liquid pressure at the top of the piston 27 and the downwardly directed force from the spring 6 in the accelerator 1. A small increase in liquid force lifts the housing 11 until the force from the spring 6 has increased correspondingly and balances the lifting force from the liquid pressure. It is important to remember that the liquid pressure first must increase until the upwardly directed hydraulic force against the housing 11 corresponds to the prestressing force of the accelerator's 1 spring 6, before the housing 1 starts to move upwards. On account of the lower spring 24 of the hammer 8 being compressed, the upwardly directed force from the spring 24 against the lower spacer 25 and, thus, the plug 23 will increase and, finally, the spring force will exceed the downwardly directed hydraulic force pressing the plug 23 against the seat 29. How much the spring 24 has to be compressed so that the spring force is to exceed the hydraulic force against the plug 23, depends on the prestressing of the accelerator's 1 spring 6. With a small prestressing, the force from the spring 24 will balance the hydraulic force against the plug 23 following a short movement of the housing 11, because the liquid pressure is low. With a vigorous prestressing, th spring 24 will not overcome the hydraulic force before the spring 24 becomes completely compressed such as shown 6. When the housing 11 is lifted to a position wherein the upwardly directed force from the spring 24 against the plug 23 is as large as the downwardly directed force against the plug 23, a further lifting av the housing 11 will cause the spring 24 to lift the plug 23 up from the seat 29 of the piston 27. How high the housing 11 has to be lifted before this happens depends, consequently, on the prestressing of the accelerator's 1 spring 6. When the plug 23 is lifted off the seat 29, liquid will immediately flow past the seat 29 towards the lower end 26 of the hammer 8, and a sudden pressure drop arises in the liquid above the piston 27 and the plug 23. The force from the spring 24 will, as suddenly and with a clear margin, exceed the hydraulic force acting on the plug 23, with the result that the spring force drives the plug 23 upwardly towards its rest within the channel 22, such as shown 8. Simultaneously, the sudden pressure drop causes the upwardly directed hydraulic force against the housing 11 to be reduced, and the force from the accelerator's 1 spring 6 drives the upper end 9 of the hammer 8 and the housing 11 downwards, with the result that the impact face 34 of the housing 11 strikes against the impact face 36 on the lower end 26 of the hammer 8. Consequently, the hammer 8 is back in the initial position such as shown in FIG. 4, and the sequence is repeated as long as a downwardly directed prestressing is maintained on the spring 6 of the accelerator 1 and, in varying the prestressing, the striking strength may be varied.

Figure 9:
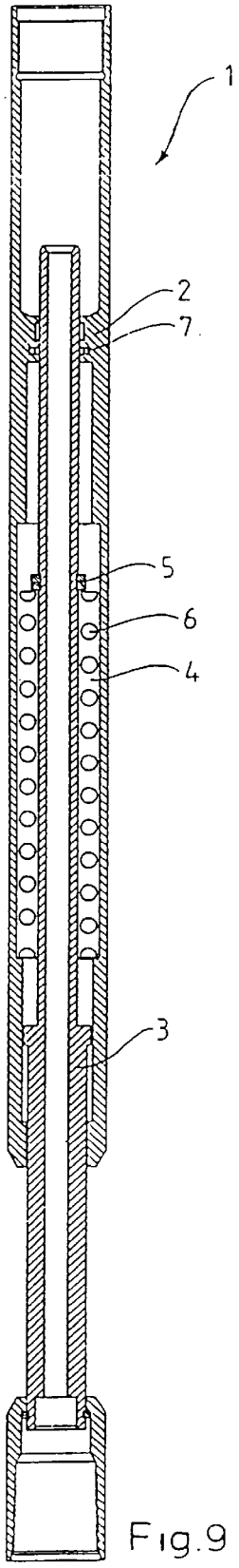
FIG. 9 shows the accelerator upon upwardly directed pretensioning of the spring.
Figure 10:
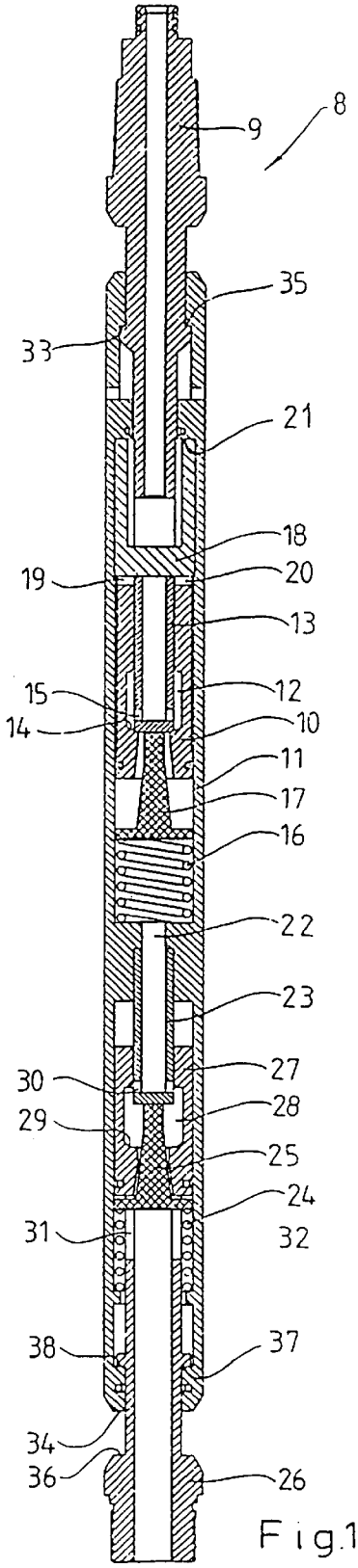
FIG. 10 shows the hammer when the upper piston just has closed and is ready to tension the spring further hydraulically, corresponding to the accelerator in FIG. 9.
Figure 11:
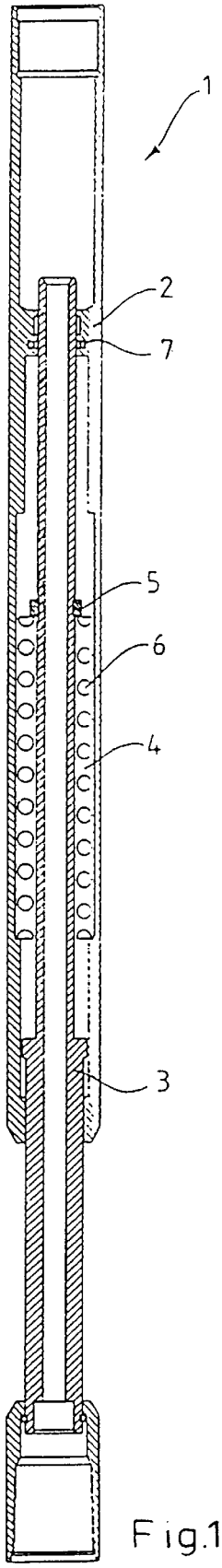
FIG. 11 shows the accelerator wherein the spring is further tensioned by the hammer.
Figure 12:
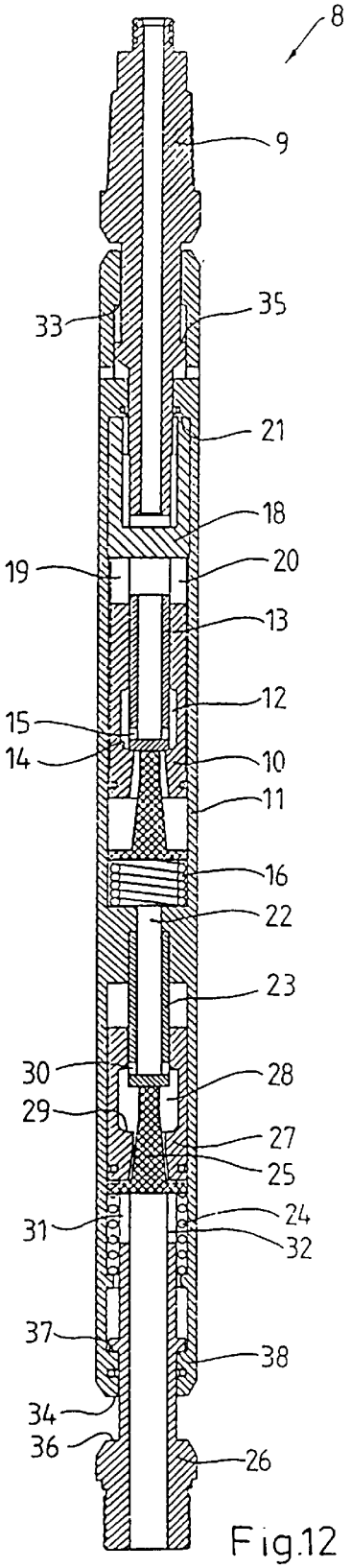
FIG. 12 shows the hammer wherein the upper piston takes an end position, just before the through-flow of liquid is opened, corresponding to-the accelerator in FIG. 11.
Figure 13:
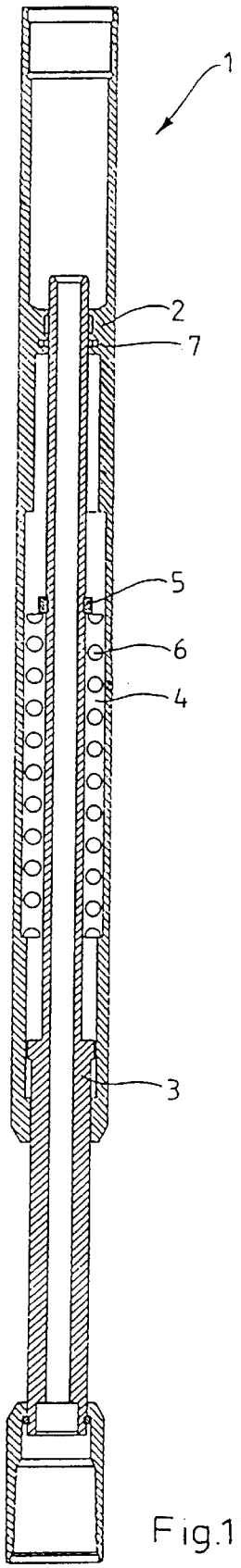
FIG. 13 shows the accelerator, the spring being released.
Figure 14:
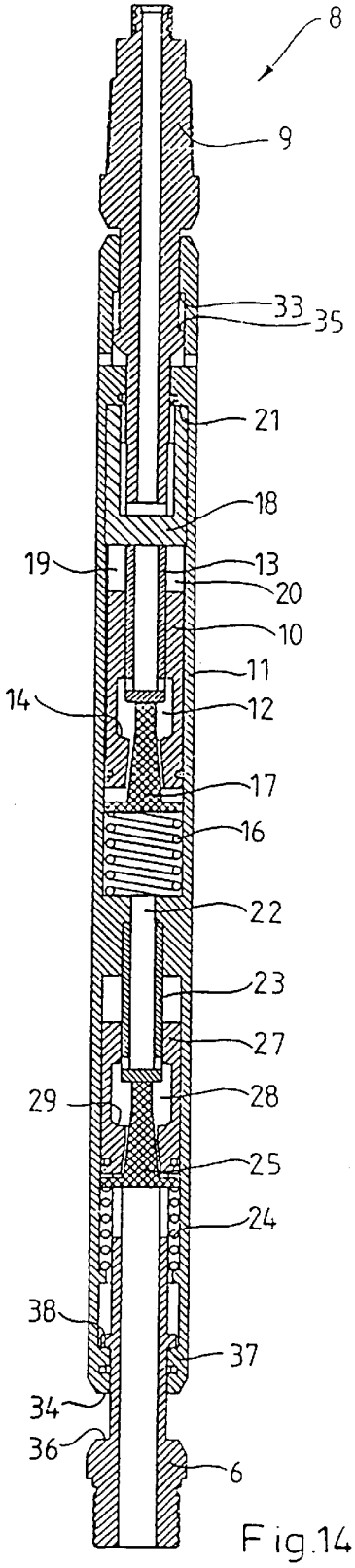
FIG. 14 shows the hammer wherein the upper piston has opened the through-flow of liquid, corresponding to the accelerator FIG. 13.
Figure 17:
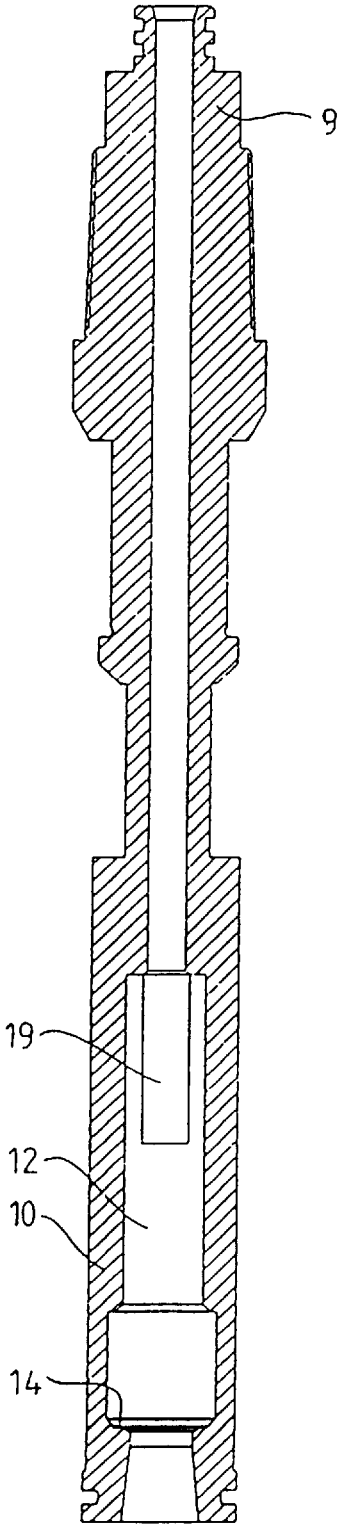
FIG. 17 shows the same as FIG. 16 in side elevational view.
Figure 15:
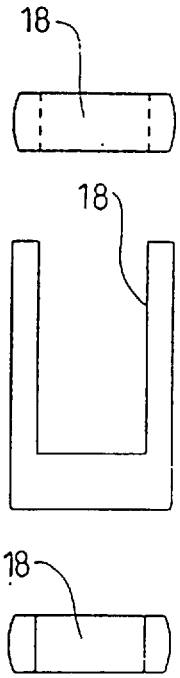
FIG. 15 shows, on a larger scale and in three projections, a hoop included in the hammer.
Figure 16:
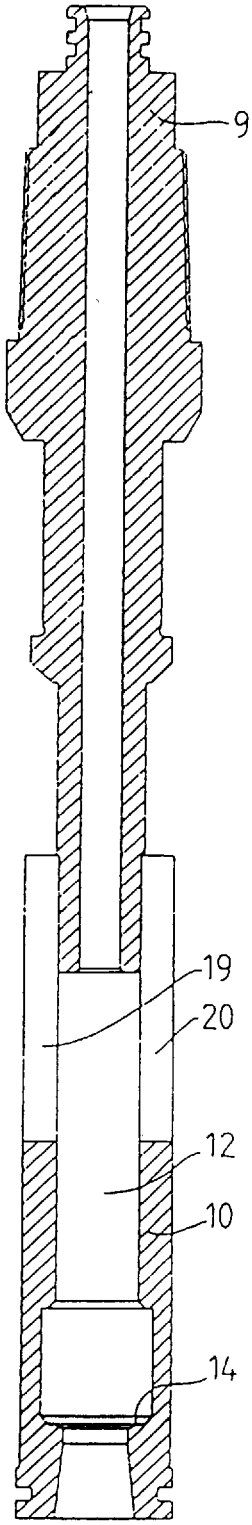
FIG. 16 shows, on the same scale and in section, the upper end of the hammer, comprising an integral piston.
Figure 18:
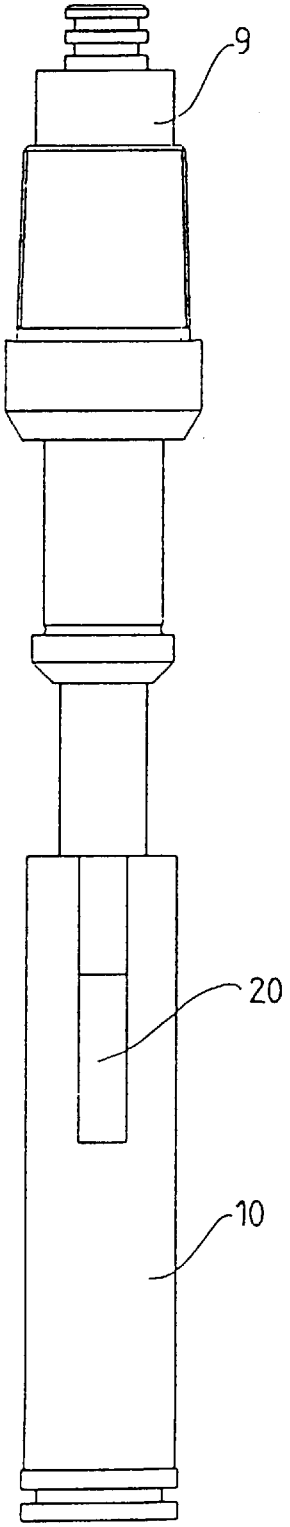
FIG. 18 shows the upper end of the hammer in side view.
Figure 19:
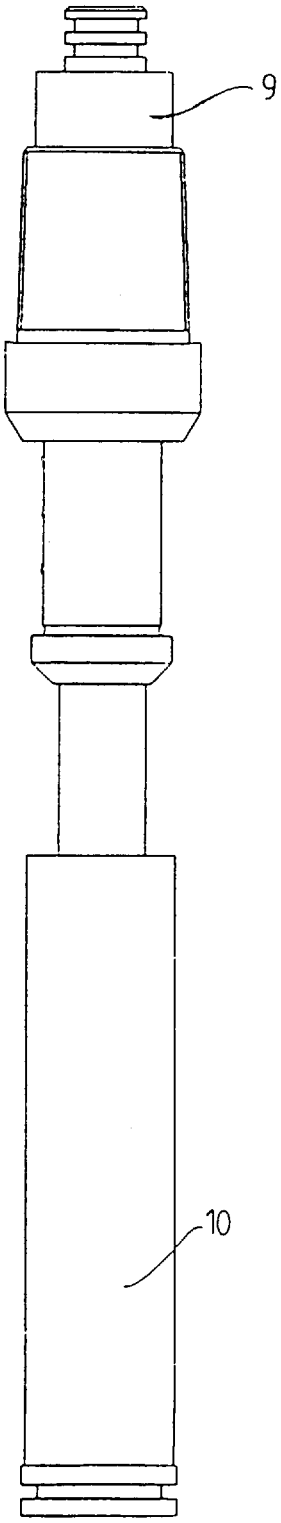
FIG. 19 shows the upper end of the hammer in front view.

Upwardly directed blows are achieved by passing liquid from a pressure source, not shown, through a supply pipe, not shown, into the upper end of the accelerator 1, flowing through the accelerator 1 and the hammer 8, simultaneously as the external pipe of the accelerator 1 is alloted an upwardly directed force, subjecting said pipe for a pulling action. Consequently, the external pipe of the accelerator 1 is lifted at the same time as the spring is compressed, see FIG. 9. The upwardly directed force is transferred through the spring 6 to the internal pipe 3 of the accelerator 1 and, from there, to the upper end 9 of the hammer 8. Thus, the hammer is lengthened as already explained and as shown in FIG. 10. On account of the fact that the upper piston 10 does not allow through-flow of liquid, the pressure of the liquid column above the piston 10 and the upper plug 13 increases. The resultant hydraulic force drives the piston 10 and the plug 13 jointly downwardly within the housing 11. The hammer's 8 upper end 9 is pulled downwardly by the piston 10 and, thus, the accelerator's 1 spring 6 is tensioned further in that the internal pipe 3 of the accelerator 1 is pulled downwardly. The plug 13 rests against the seat 14 with a force constituting the difference between a downwardly directed hydraulic force acting against the plug 13 and an upwardly directed force exerted by the upper spring 16 against the plug's 13 lower face, through the spacer 17. It is important to remember that, prior to the piston 10 and the plug 13 start to move downwardly within the housing 11, the liquid pressure first has to increase such that the prestressing of the accelerator's 1 spring 6 is overcome. If the prestressing is small, only a small pressure increase is sufficient to start the downward movement of the piston 10 and the plug 13. After a certain movement of the piston 10 and the plug 13, a certain upwardly directed force from the spring 16 is acting against the plug 13. The downwardly directed hydraulic force depends on the liquid pressure and, consequently, on the prestressing of the accelerator's spring 6. With a small prestressing, even a short movement of piston 10 and plug 13 will cause the force from the spring 16 to balance the hydraulic force acting against the plug 13. If the prestressing and, consequently, the liquid pressure is larger, the piston 10 and the plug 13 have to move a little further prior to the force from the spring 16 balances the hydraulic force acting on the plug 13. If the prestressing of the spring 16 is large, the hydraulic force is not balanced before the spring 24 is completely compressed and compact. Subsequent to the forces acting against the plug 13 are balanced, the plug 13 will not longer follow the piston 10 downwardly, see FIG. 12. As soon as the piston 10 is further pressed downwardly by means of the liquid pressure, the piston 10 leaves the plug 13, such that an aperture therebetween occurs at the seat 14. Therefore, liquid flows past the seat 14 and further downwardly within the hammer 8 towards the lower end 26 thereof, and a sudden pressure drop arises at the top of the piston 10 and the plug 13. Consequently, the force from the spring 16 exceeds, with a good margin, the hydraulic force acting against the plug 13, and the spring 6 drives the plug 13 upwardly, to rest against the hoop 18, see FIG. 14. Also, the pressure drop causes the downwardly directed hydraulic force against the piston 10 to disappear, and the spring 6 within the accelerator 1 pulls the upper end 9 of the hammer 8 upwardly, such that the impact face 35 of the upper end 9 impinges the impact face 33 of the housing 11. An upwardly directed stroke is supplied to the housing 11 and, thus, to the hammer's 8 lower portion 26, through the contact faces 37, 38. Thus, the hammer 8 is back into the position as shown FIG. 10, and the sequence is repeated as long as an upwardly directed prestressing is maintained on the spring 6 of the accelerator 1, and, by varying the prestressing, the striking strength can be varied.

I claim:

1. A double-acting hydraulic striking tool comprising a plurality of pistons which are adapted to open and close a flow of liquid, and wherein one of the plurality of pistons in a closed condition and with an appurtenant moving mass is displaceable from a first end position to a second end position by a hydraulic force; a spring is simultaneously tensioned by the hydraulic force to thereby open said piston to permit the flow of liquid, and neutralize the hydraulic force against the piston, said tensioned driving spring driving the mass back to rest against a rigid portion of striking tool, whereby a striking effect arises such that the piston returns to the first end position and again closes the flow of liquid and wherein the pistons are adapted to open to permit the flow of liquid when the liquid pressure exceeds an adjustable value.

2. The double-acting hydraulic striking tool as set forth in claim 1, wherein a plug is adapted to seal against a seat for each piston whereby, liquid pressure acting on the pistons presses the plug against the seat, a spring simultaneously lifts the plug off the seat and opens the piston to allow the flow of liquid, whereby the piston opens to permit the flow of liquid when the force from the spring exceeds the oppositely directed hydraulic force of the liquid pressure against the plug.

3. The double-acting hydraulic striking tool as set forth in claim 2, wherein prestress of the springs can be adjusted by supplying an external axial force to the striking tool, whereby the stroke of the pistons is determined.

4. The double-acting hydraulic striking tool as set forth in claim 3, wherein both pistons are opened to permit the flow of liquid when the striking tool is not allotted an external axial force.

5. The double-acting hydraulic striking tool as set forth in claim 4, wherein the spring is adapted to be pretensioned when the striking tool is allotted an external axial tensile force, and the force is adapted to be pretensioned when the striking tool is allotted an external axial pressure force.

6. The double-acting hydraulic striking tool as set forth in claim 5, wherein the piston is rigidly connected to an upper end of a hammer which defines a moving mass for substantially upwardly directed blows, and simultaneously therewith the piston is rigidly connected to a lower end of the hammer and a housing of the hammer, which constitutes a moving mass for substantially downwardly directed strokes.

* * * * *